US007874297B2

(12) United States Patent
Streck

(10) Patent No.: US 7,874,297 B2
(45) Date of Patent: Jan. 25, 2011

(54) TOBACCO SUBSTITUTE PRODUCTS

(76) Inventor: John J. Streck, 2404 Ash, Hays, KS (US) 67601

( * ) Notice: Subject to any disclaimer, the term of this patent is extended or adjusted under 35 U.S.C. 154(b) by 1244 days.

(21) Appl. No.: 11/478,230

(22) Filed: Jun. 29, 2006

(65) Prior Publication Data

US 2007/0000506 A1 Jan. 4, 2007

Related U.S. Application Data

(60) Provisional application No. 60/694,647, filed on Jun. 29, 2005.

(51) Int. Cl.
*A24B 15/00* (2006.01)

(52) U.S. Cl. ..... 131/359; 131/347

(58) Field of Classification Search ..... 131/359
See application file for complete search history.

(56) References Cited

U.S. PATENT DOCUMENTS

| | | | | |
|---|---|---|---|---|
| 4,007,290 | A | | 2/1977 | Zeitlin et al. |
| 4,165,752 | A | | 8/1979 | Bustmante |
| 4,317,837 | A | | 3/1982 | Kehoe et al. |
| 4,321,255 | A | | 3/1982 | Boden |
| 4,655,231 | A | | 4/1987 | Ray et al. |
| 4,656,177 | A | | 4/1987 | Sunshine et al. |
| 4,660,577 | A | | 4/1987 | Sensabaugh et al. |
| 4,696,315 | A | | 9/1987 | Summers |
| 4,817,640 | A | | 4/1989 | Summers |
| 4,975,295 | A | * | 12/1990 | Sierra ..... 426/285 |
| 4,987,907 | A | | 1/1991 | Townend |
| 5,092,352 | A | | 3/1992 | Sprinkle, III et al. |
| 5,456,677 | A | | 10/1995 | Spector |
| 5,488,962 | A | | 2/1996 | Perfetti |
| 5,502,056 | A | | 3/1996 | Breitbarth |
| 6,024,988 | A | | 2/2000 | Ream et al. |
| 6,165,516 | A | | 12/2000 | Gudas et al. |
| 6,399,131 | B2 | * | 6/2002 | Zeller et al. ..... 426/520 |
| 6,416,806 | B1 | | 7/2002 | Zhou |
| 6,444,241 | B1 | | 9/2002 | Tyrpin et al. |
| 2007/0031539 | A1 | | 2/2007 | Calton, Jr. |

* cited by examiner

*Primary Examiner*—Carlos Lopez
(74) *Attorney, Agent, or Firm*—Law Office of Mark Brown, LLC; Mark E. Brown

(57) ABSTRACT

A tobacco-like product includes a coffee, tea, cocoa or soy base material. A flavor ingredient is added to the base material and the final product is formulated to a suitable form, such as lozenges, tablets, cakes, shredded, powdered and capsules. In the practice of the method of the present invention, a tobacco-like product is manufactured by selecting a base material, drying the base material, converting the base material, adding a flavor ingredient, adjusting a caffeine content, processing the combined ingredients, formulating the final product and packaging the final product.

4 Claims, 1 Drawing Sheet

TOBACCO SUBSTITUTE PRODUCTS

CROSS-REFERENCE TO RELATED APPLICATION

The present application claims priority in provisional U.S. Patent Application No. 60/694,647, filed Jun. 29, 2005, which is incorporated herein by reference.

BACKGROUND OF THE INVENTION

1. Field of the Invention

The present invention relates generally to tobacco analogue products and in particular to chewing tobacco and snuff analogue products manufactured from coffee, tea and related base materials, and methods of manufacturing same.

2. Description of the Related Art

In the field of products for chewing and inhaling through the nostrils, chewing tobacco and snuff are very popular among consumers. They tend to satisfy oral cravings, which are a well-known psychological condition. Consequently, many consumers derive satisfaction and enjoyment from chewing tobacco, chewing gum, snuff, etc. Tobacco has been the traditional base material for chewing tobacco and snuff products.

Caffeinated products are also widely popular, and include coffee, tea, cola beverages and other consumables. Caffeine has also been included in formulations for chewing gum and other products. However, heretofore there has not been available tobacco-like products with the advantages and features of the present invention, including a method of manufacturing such products.

BRIEF DESCRIPTION OF THE INVENTION

In the practice of an aspect of the present invention, tobacco-like products are provided and comprise base materials, such as coffee or tea, for delivering caffeine in products which are otherwise functionally comparable to chewing tobacco and snuff. The materials can be provided with flavor-enhancing and other ingredients. A manufacturing method is provided, which includes converting a base material to suitable particles, adding flavor ingredients, adjusting caffeine contents, processing, formulating and packaging the finished product conveniently for consumption.

DETAILED DESCRIPTION OF THE PREFERRED EMBODIMENTS

I. Introduction and Environment

Figure 1:
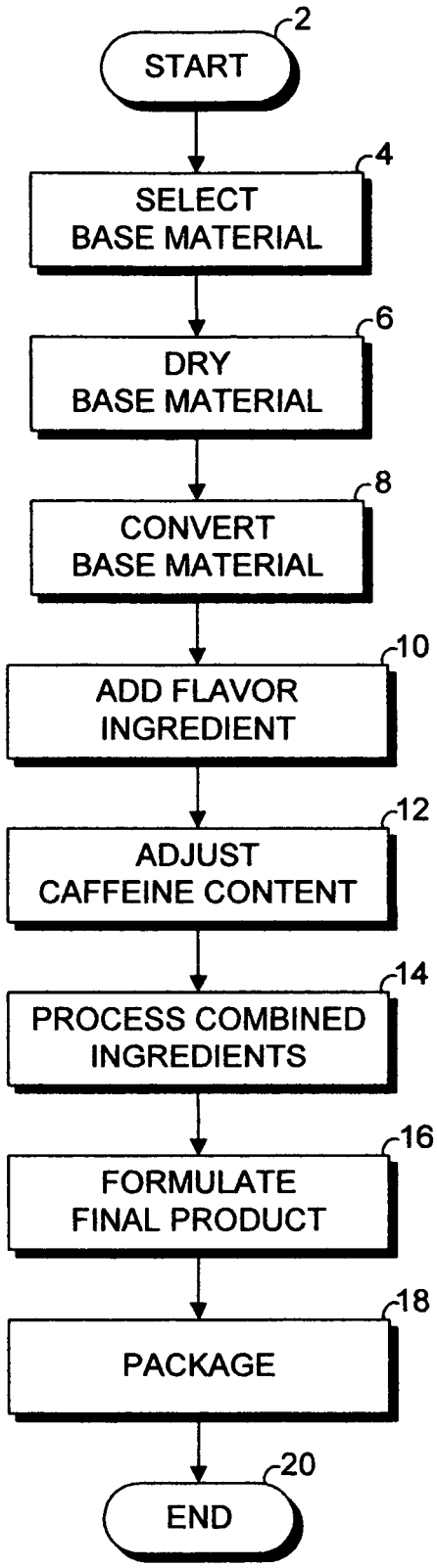
FIG. 1 is a flow diagram of a method of manufacturing a tobacco-like product embodying an aspect of the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. Said terminology will include the words specifically mentioned, derivatives thereof and words of similar meaning. The invention can be fabricated in various sizes and configurations from a wide variety of suitable materials, which are chosen for their characteristics according to the intended use and the operation of the invention.

II. Tobacco-Like Product Manufacturing Method

Referring to FIG. 1 in more detail, a process or method of manufacturing a tobacco-like product from substitute base materials is shown and commences at start 2. A base material is selected at step 4. The base material can comprise coffee (coffee arabica), tea (thea sinansis), or other suitable organic materials, including various analogs produced from soy beans, etc. It will be appreciated that the variety of suitable base materials is virtually unlimited. By way of example, caffeinated base materials, such as coffee, tea, cocoa, etc. can be utilized for their stimulating properties. However, base materials can be chosen for other characteristics, such as delivery of vitamin and nutrition supplements, pharmacological agents, etc. Base materials with pain relieving, anti-inflammatory and antihistamine active ingredients can also be utilized.

Base materials can be chosen for their active ingredients, such as caffeine, and other characteristics such as flavor, aroma, texture, shelf life, manufacturing process compatibility, etc. Certain base materials, such as tea, can contain essential oils such as mint, menthol, cinnamon, spearmint, cloves, etc. Base materials can be blended and mixed as appropriate to obtain desired end product formulations.

The base material can be dried at step 6, although "green" tea and other base materials can be utilized without active drying procedures. The drying step 6 can comprise roasting, particularly for coffee, and various other procedures as appropriate for the base material being utilized. The base material is converted at step 8, which can comprise comminuting, shredding, pulverising, grinding, etc. Stringy compositions may be preferred for products resembling chewing tobacco, whereas fine-ground processing may be indicated for snuff-like products. Procedures for grinding coffee beans are well-known and can result in "drip", "regular" or "fine" coffee grounds, as required. The converted base material is preferably in a form adapted for consumption (e.g. shredded tea leaves or coffee beans ground into snuff-like fine particles), or in a form adapted for formulation into such a consumable formulation.

A flavor ingredients addition step optionally occurs at 10. The range of flavors, natural and artificial, is virtually unlimited. For example, a wide variety of fruit flavors is available for adding to the converted base material in any suitable manner. Multiple flavors can be provided and suitably intermixed in the base material. Flavor, as used herein, includes aroma characteristics, which likewise vary considerably and generally correlate to taste. A caffeine content adjustment step can be provided at step 12. The techniques for adding caffeine and decaffeinating the base material are well-known. The combined ingredients are processed at step 14, which can include mechanical, chemical, thermal and other process steps.

The finished product is formulated at step 16, which can involve pressing, molding, packing, etc. Forms for the finished product include powdered, ground, shredded, lozenges, pellets, pods, cakes, tablets, strips, sticks, etc. The finished product can be packaged at 18, whereafter the methodology proceeds to an end at 20.

In use, the tobacco-like product, such as chewing tobacco or snuff, can deliver appropriate levels of caffeine or other active ingredients. For example, 50-100 mg of caffeine can be provided as a dose for stimulating the user. It will be appreciated that the caffeine dosages can vary considerably with manufacturing and quantities consumed. Caffeine tends to be absorbed quite rapidly from the oral cavity, whereby the stimulating effects derived from using the tobacco-like products of the present invention will be experienced relatively quickly by the users. Because such products are consumed like chewing tobacco and snuff, they tend to be acceptable to nearby individuals and they avoid such objectionable byproducts as second-hand smoke, etc. Hence, consumers can discreetly use such products for oral gratification and stimulation in a wide variety of public settings, which would otherwise have smoking bans in place. Such settings include public transportation (e.g. airliners and buses), restaurants, classrooms, offices, etc. The finished products can be relatively compact and easily portable.

It is to be understood that the invention can be embodied in various forms, and is not to be limited to the examples discussed above. Other components, ingredients, formulations, steps and configurations can be utilized in the practice of the present invention. For example, manufacturing procedures vary widely for different base materials and ingredients. It will be appreciated that the appropriate manufacturing procedures can be utilized for a wide variety of base materials, ingredients and desired characteristics of the finished tobacco-like products.

Having thus described the invention, what is claimed as new and desired to be secured by Letters Patent is:

1. A method of manufacturing a tobacco substitute product, which comprises the steps of:

providing a base material chosen from among the group consisting of coffee (coffee arabica), tea (thea sinansis), cocoa and soy;

drying said base material;

converting said base material to a form adapted for oral placement;

adding a flavor ingredient to said base material;

adjusting a caffeine level of said base material;

processing said base material and said flavor ingredient into a final product; and formulating said final product to a form adapted for oral placement and chosen from among the group consisting of chewing tobacco substitute, and snuff substitute.

2. The method according to claim 1, which includes the additional step of packaging the final product.

3. The method according to claim 1, which includes the additional step of providing said flavor ingredient with a fruit flavor.

4. The method according to claim 1, which includes the additional step of formulating said final product in a final form chosen from among the group consisting of ground, shredded, lozenges, pellets, pods, cakes, tablets, strips, sticks and capsules.

* * * * *